US007322815B2

(12) United States Patent
Izzo

(10) Patent No.: US 7,322,815 B2
(45) Date of Patent: Jan. 29, 2008

(54) SYSTEM FOR THE PRODUCTION OF COMPOSITE MATERIAL SLABS

(75) Inventor: Antonio Izzo, Montesarchio (IT)

(73) Assignee: Seieffe, S.R.L., Bonea (IT)

( * ) Notice: Subject to any disclaimer, the term of this patent is extended or adjusted under 35 U.S.C. 154(b) by 63 days.

(21) Appl. No.: 10/521,404

(22) PCT Filed: Jul. 10, 2003

(86) PCT No.: PCT/IT03/00434

§ 371 (c)(1),
(2), (4) Date: Jan. 18, 2005

(87) PCT Pub. No.: WO2004/011220

PCT Pub. Date: Feb. 5, 2004

(65) Prior Publication Data

US 2005/0213429 A1 Sep. 29, 2005

(30) Foreign Application Priority Data

Jul. 30, 2002 (IT) ..... NA2002A0045

(51) Int. Cl.
*B28B 13/02* (2006.01)

(52) U.S. Cl. ..... 425/447; 425/449; 425/DIG. 108

(58) Field of Classification Search ..... 425/447, 425/449, DIG. 108
See application file for complete search history.

(56) References Cited

U.S. PATENT DOCUMENTS

| | | | | |
|---|---|---|---|---|
| 1,456,858 | A | 5/1923 | Partridge | |
| 3,414,239 | A | 12/1968 | Eirich et al. | |
| 4,432,714 | A * | 2/1984 | Forry et al. | 425/83.1 |
| 4,478,896 | A * | 10/1984 | Barnes et al. | 427/212 |
| 4,979,960 | A * | 12/1990 | Rexius et al. | 8/402 |
| 5,393,214 | A * | 2/1995 | Irie et al. | 425/81.1 |
| 6,846,552 | B2 * | 1/2005 | Dalla Valle | 428/220 |

FOREIGN PATENT DOCUMENTS

| | | | |
|---|---|---|---|
| DE | 196 37 096 A1 | | 3/1998 |
| FR | 2 401 005 | | 3/1979 |
| WO | WO01/60590 | * | 8/2001 |

* cited by examiner

*Primary Examiner*—Yogendra N Gupta
*Assistant Examiner*—Maria Veronica Ewald
(74) *Attorney, Agent, or Firm*—Michael J. Striker

(57) ABSTRACT

The invention relates to a system for the production of slabs of composite material characterized by a particular unloading system of the material from the mixers (1, 2) to a homogenizing disc (7) so as to provide a constant, homogeneous composition of the material in the different working cycles, and by a particular distribution system of the material into the rubber moulds (23) so that the material is not further moved once unloaded from the homogenizing disc. The latter condition allows, in addition to the aesthetic uniformity of the product, further colours and different mixtures to be added to the slab being formed.

5 Claims, 8 Drawing Sheets a b c d

SYSTEM FOR THE PRODUCTION OF COMPOSITE MATERIAL SLABS

CROSS-REFERENCE

The invention described and claimed hereinbelow is also described in PCT/IT 2003/000434, filed on Jul. 10, 2003 and NA2002A000045, filed on Jul. 30, 2002. This Italian Patent Application, whose subject matter is incorporated here by reference, provides the basis for a claim of priority of invention under 35 U.S.C. 119 (a)-(d).

There are known systems for the production of slabs of composite materials such as calcareous and siliceous granulates, granites, quartz, additives, binding agents of several kinds.

Typically such slabs have a size up to 3.10×1.42 m and a thickness that can vary from 1.2 to 3 cm, and different dimensions as well.

The slabs may be used as a whole or portions thereof may be cut and shaped at will.

Such product has a large variety of fields of application, i.e. flooring and coating both for the interior and the exterior of buildings, partitions as well as lining of any surface such as tops for kitchen, bathrooms, desks, etc.

The composite material consists of the assembly of granulates of different size and kind such as quartz, granite, marble, wood, baked clay, glass, mirror, plastics, ceramics, brass, aluminium and others that can be combined by their nature with one another by means of binding rosins, cements, pitches or generally bonding agents.

The current production method can be summarized as follows:

a) storing the granulates into suitable silos;
b) stocking binders into suitable tanks;
c) daily storing binders at the operation temperature;
d) mixing granulates, binders, and colours (mixtures are of different colours) by several mixers with vertical axes;
e) homogenizing the different coloured mixtures mixed at preceding item d) by a homogenizer consisting of a disc rotating about itself. The mixture produced in the mixers located at a higher level is transferred to the homogenizing disc by a mobile conveyor with a frustoconical shape, so-called "unloading channel", moved by a linkage; the double operation allows the mixture to be distributed in layers. However, such distribution does not allow the mixture to be homogeneously stratified on the surface of the disc because of the way by which it is carried out;
f) unloading the mixture from the homogenizing disc by a rotatable double-bucket drive, so-called unloading bucket, which is synchronized with the rotation speed of the disc;
g) transporting the mixture by belt conveyor;
h) calibrating the homogenized material of preceding item f) by a pair of opposite rollers;
i) transporting the mixture by belt conveyor to the conveyor belt of the distribution tank lying on a supporting frame of iron. Such tank is longitudinally crossed by a drive shaft provided with vanes having little shovels at their ends that further mix the amount of mixture necessary to form a slab by their rotation movement;
j) unloading the mixture from the conveyor belt to the distribution tank by means of a paddle driven electrically and placed at the head of the conveyor belt;
k) unloading the mixture to a rubber mould from the distribution tank movable along the whole length of the mould.

A longitudinal shaft driven by a geared motor and provided with vanes having little shovels at their ends that further mix and unload the mixture during the filling step to the rubber mould is provided inside the distribution tank.

The distribution tank rests on the supporting frame of iron called "supporting framework" hydraulically moved to the vertical direction.

Such framework has the double function of determining the periphery of the rubber mould and acting as sliding surface of the distribution tank during the filling step of the material into the same mould.

The production and filling steps of the mixture is now ended. The further production method consists in that the material is compacted under vacuum and then hardened in oven and taken away therefrom for being stocked.

A number of problems in the end product are caused by such production method during the slab moulding step, and namely:

1) the colours of the different slabs from the same and different production cycles are not homogeneous;
2) a non-homogeneous distribution both of the colours and the balls over the whole surface of the slab in case of a product consisting of mixtures with different colours in the presence of balls/lumps;
3) during the filling step of the first length of the slab a bad distribution of the mixture is obtained systematically and is made visible by the presence of colour thickenings;
4) during the filling step, pellets of materials with rectangular and/or circular shape and different size are visible in each slab indicating a defect thereof. Such pellets consist of very thin portions of silica, limestone, etc. bound by the binding agent that are produced by the longitudinal shaft as well as the buckets of the mixing vanes rubbing the walls of the distribution tank;
5) the need of cleaning the distribution tank cyclically during the production steps because of the thickening of the mixture material on the longitudinal shaft as well as the buckets of the mixing vanes and the inside walls of the distribution tank;
6) the mixture is homogenized in the distribution tank by the rotation of the buckets of the mixing vanes even if it is not requested, particularly the mixtures with different colours tend to blend.

Furthermore, in addition to causing the colours of the slabs not to be homogenized as well as having the above-mentioned drawbacks, the method described does not allow slabs with both longitudinal and transversal veins as well as leopard skin colourings to be produced in order to provide products similar to the natural products such as marble and granite.

Therefore, in order to solve the problems mentioned above it is needed:

A) allowing the mixtures to be unloaded from the mixers to the homogenizing disc on a constant and continuous basis so that mixtures with a thickness proportional to the ratio between the quantities of different mixtures are stratified on the surface of the disc;
B) distributing the mixture into the rubber mould without any further movement of the mixture after its unloading from the homogenizing disc to avoid the problems mentioned above;
C) shaping the slabs outside the rubber mould with the advantage of the following operations before or during the step of unloading the mixture to the mould:
   adding quantities and qualities of dry colours or colouring mixed liquid pastes, varying the kind of mixtures among silica, granulates, colour, and binding agent so as to produce veins or leopard skin effect, which is typical of the natural products such as granite and marble.

SUMMARY OF THE INVENTION

The present invention seeks to provide a composite material slab production system that allows the conditions of items A), B) and C) to be satisfied.

In order to solve the problems mentioned above it has been envisaged to provide levelling/proportioning hoppers along with conveyor belts with suitable size having the function of extractors as well as conveyers and batchers of the mixture.

In particular the solution satisfying the condition of preceding item A) is to replace the alternately movable conveyer (unloading channel) with one or more conveyor/extractor belts put between the mixing area and the homogenizing disc, an overhanging levelling hopper and calibration rollers as well.

The solution satisfying the preceding items B) and C) is as follows:

replacing the distribution tank with a levelling hoppers;

providing a belt having the double function of extracting from the preceding levelling hopper and batching to the underlying further hopper the mixture on the rubber mould, the whole belt assembly being movable;

alternately moving the conveyor belt of the preceding distribution hopper, thus avoiding the paddle placed at the head thereof.

Such solutions will be better understood with reference to the accompanying drawings showing schematically an embodiment of the invention by way of an illustrative, not limiting example.

DETAILED DESCRIPTION OF THE PREFFERED EMBODIMENTS

Figure 1:
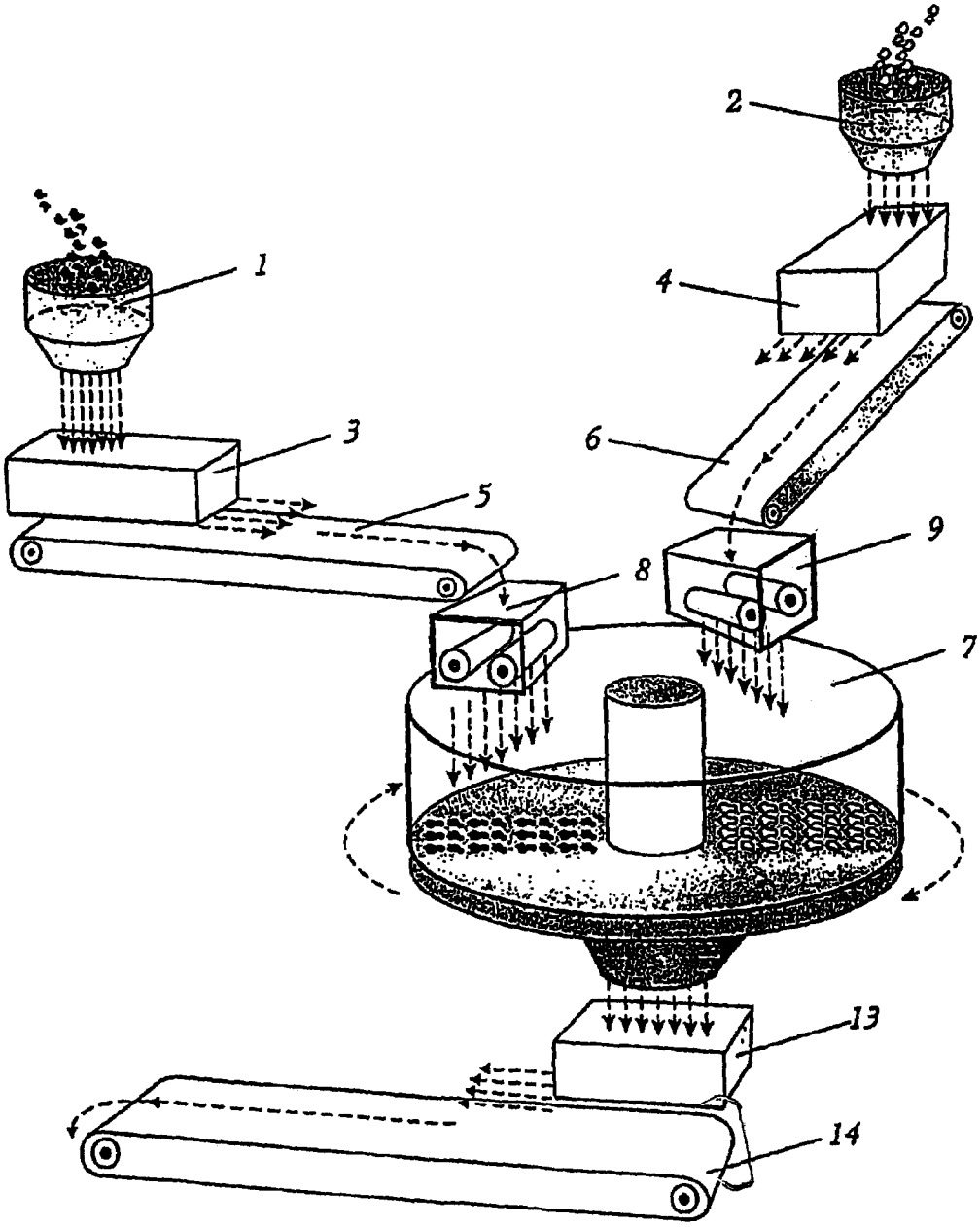
FIG. 1 shows the step of unloading different mixtures to the homogenizing disc.
Figure 2:
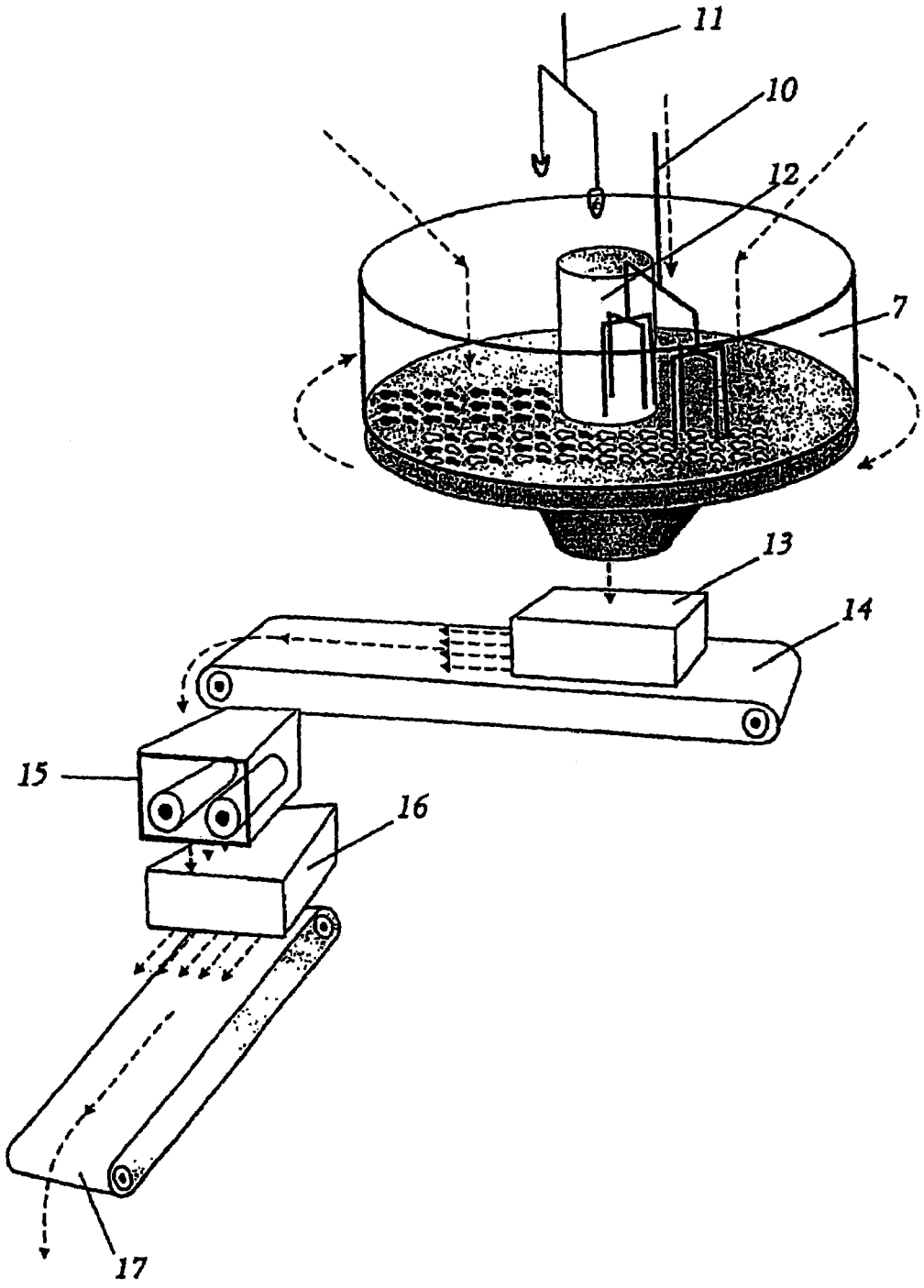
FIG. 2 shows the step of homogenizing the mixtures in the homogenizing disc.
Figure 3:
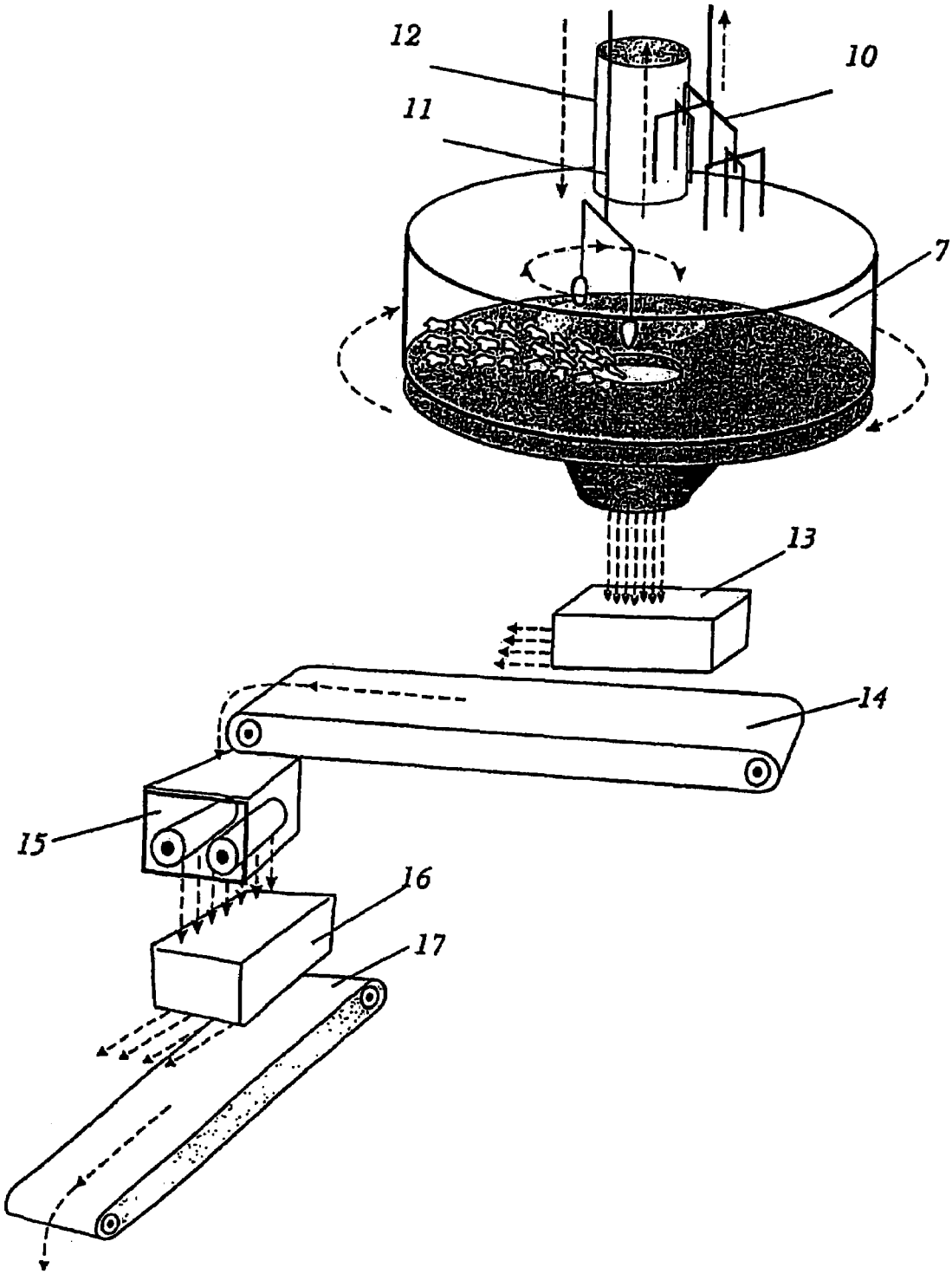
FIG. 3 shows the unloading step from the homogenizing disc through the central drum and the next levelling hopper to a conveyor/extractor belt, and the transportation of the extracted mixture through calibration rollers to the underlying belt.
Figure 4:
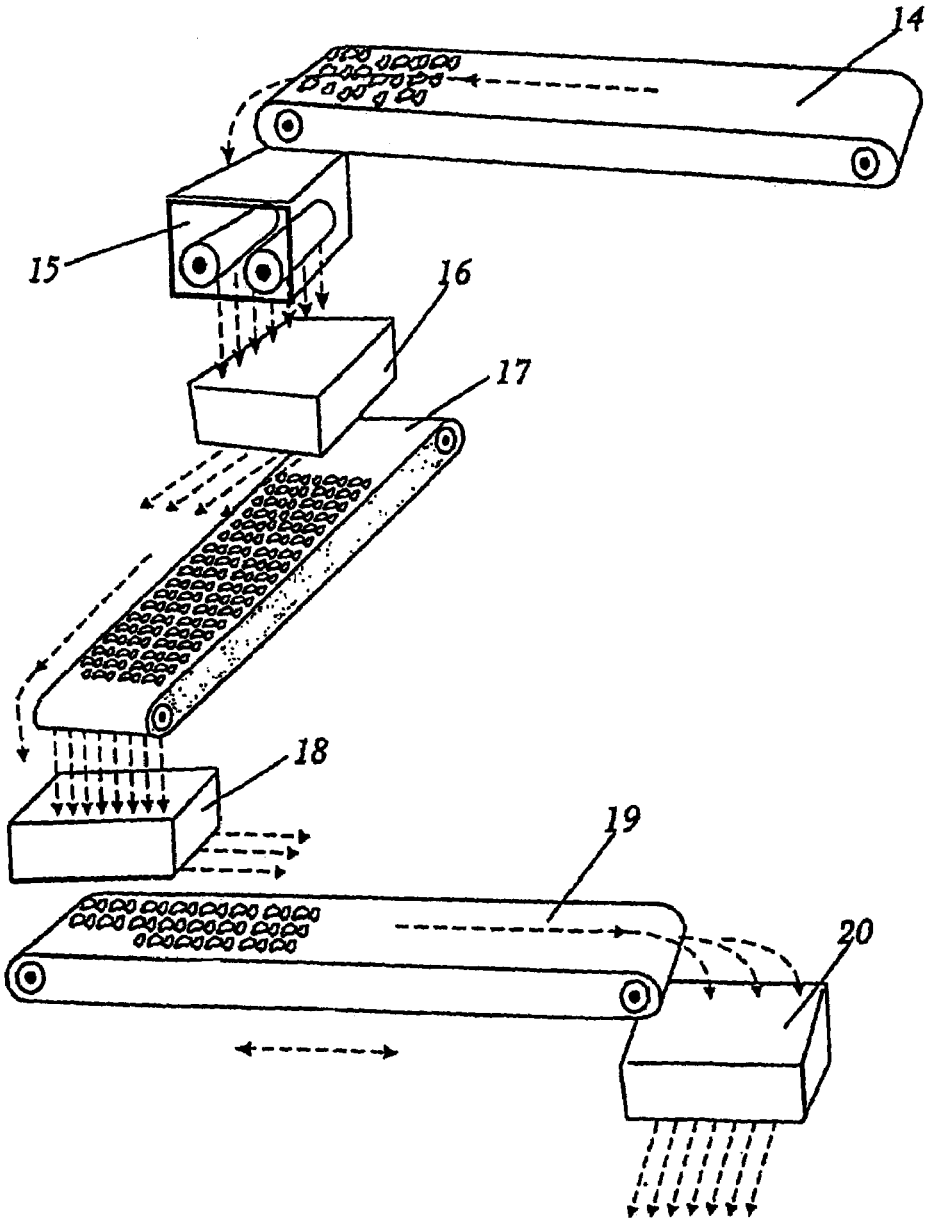
FIG. 4 shows the step of loading the mixture from the levelling hopper to the conveyor belt and the step of unloading the mixture from the latter to the underlying levelling hopper.
Figure 5:
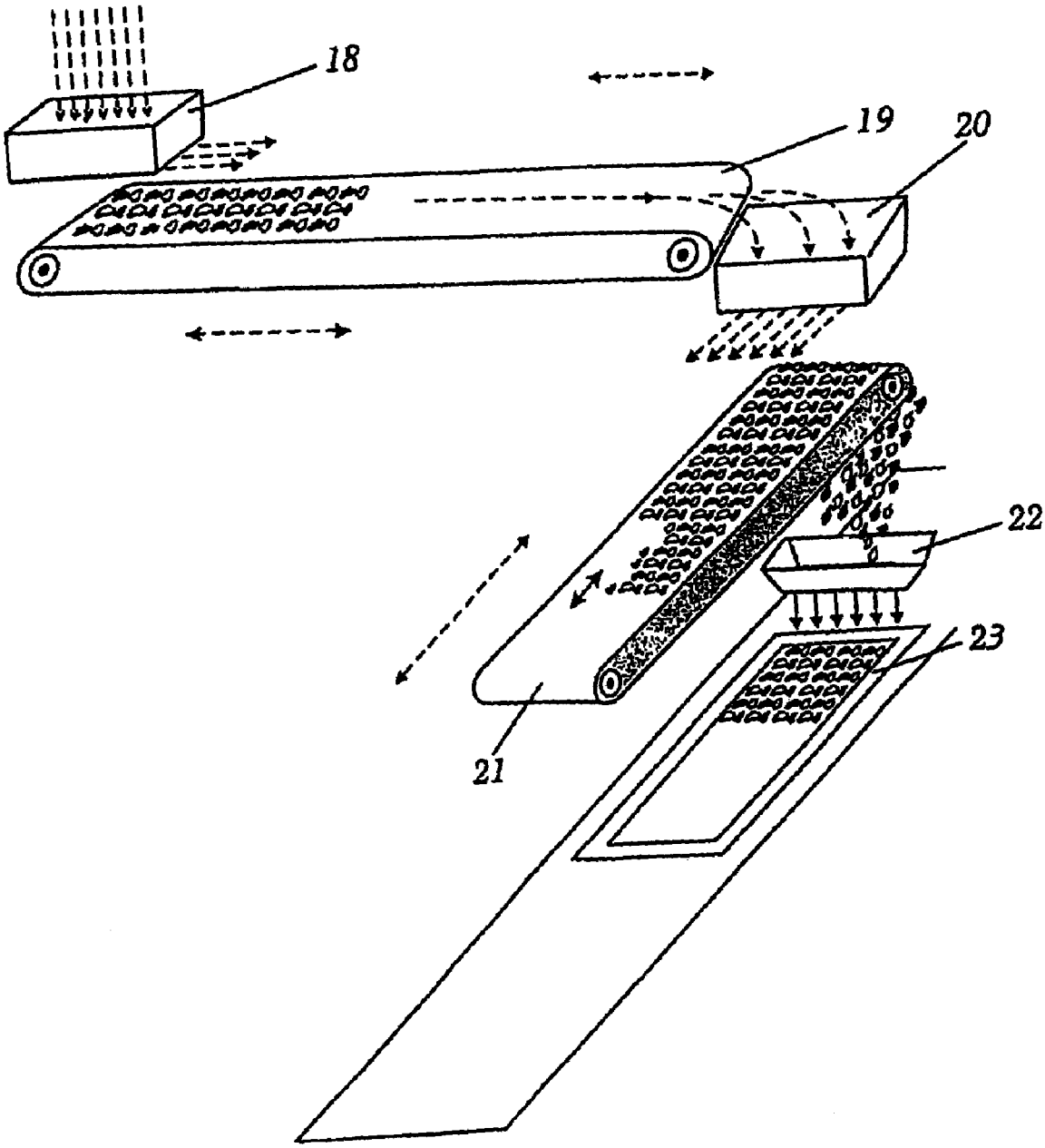
FIG. 5 shows the details of the movement of the extracting belt and the relative steps of forming the slabs.
Figure 6:
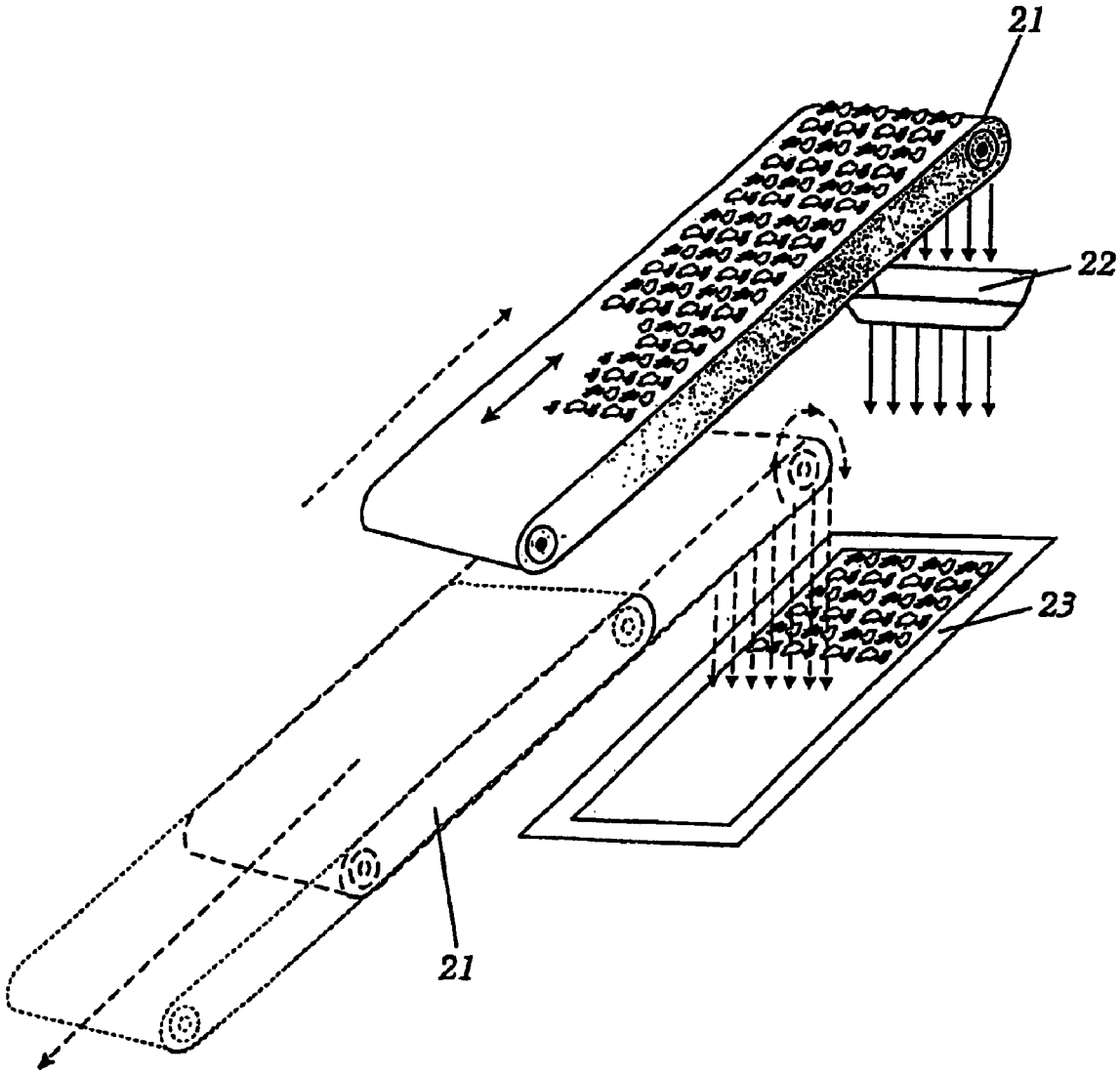
FIG. 6 shows the details of the movement of the extracting belt during the step of unloading the mixture to the rubber mould through the underlying levelling hopper.
Figure 7:
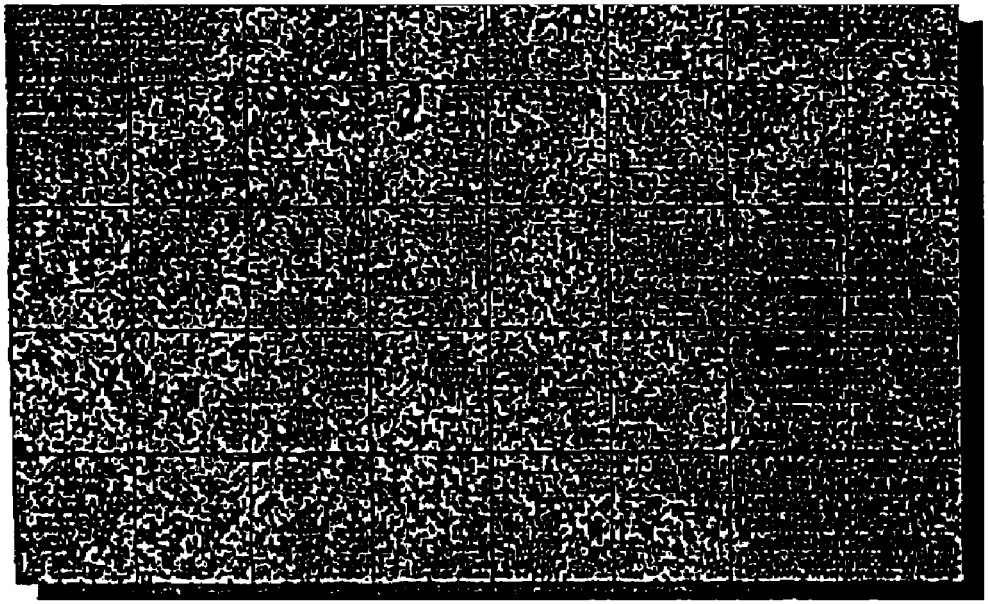
FIG. 7 shows the difference between the product of the conventional method (a) and the product of the present invention (b).
Figure 7:
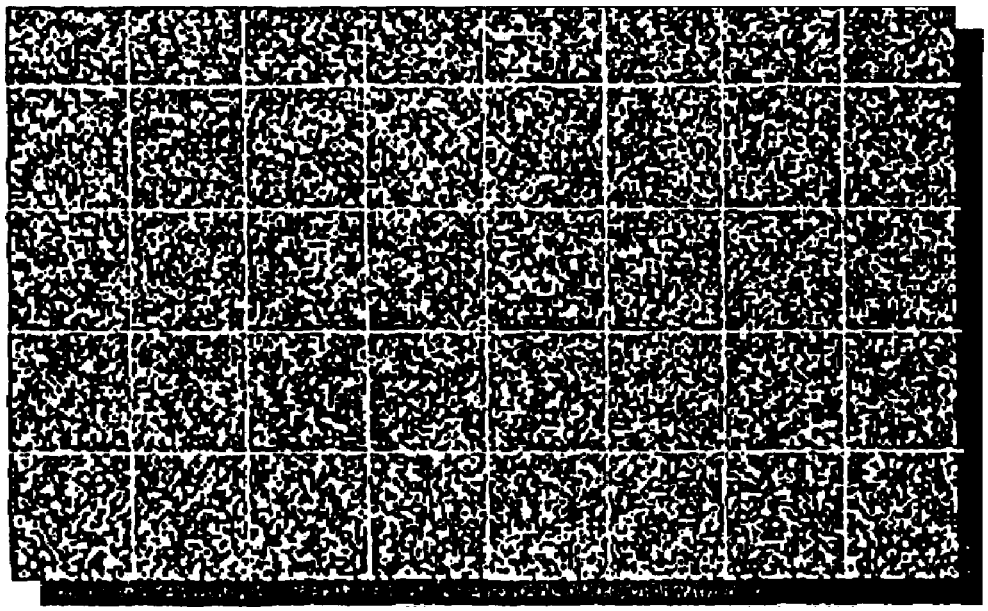
Figure 8:
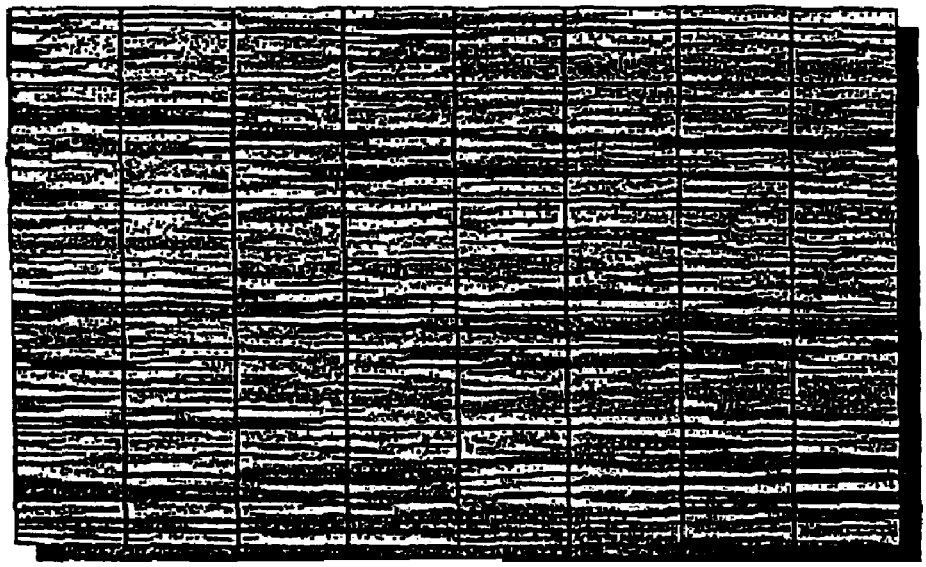
FIG. 8 shows a slab with veins of the marble type (c) and a slab with leopard skin colourings (d) having different colours, both slabs being formed by the method of the system of the present invention.
Figure 8:
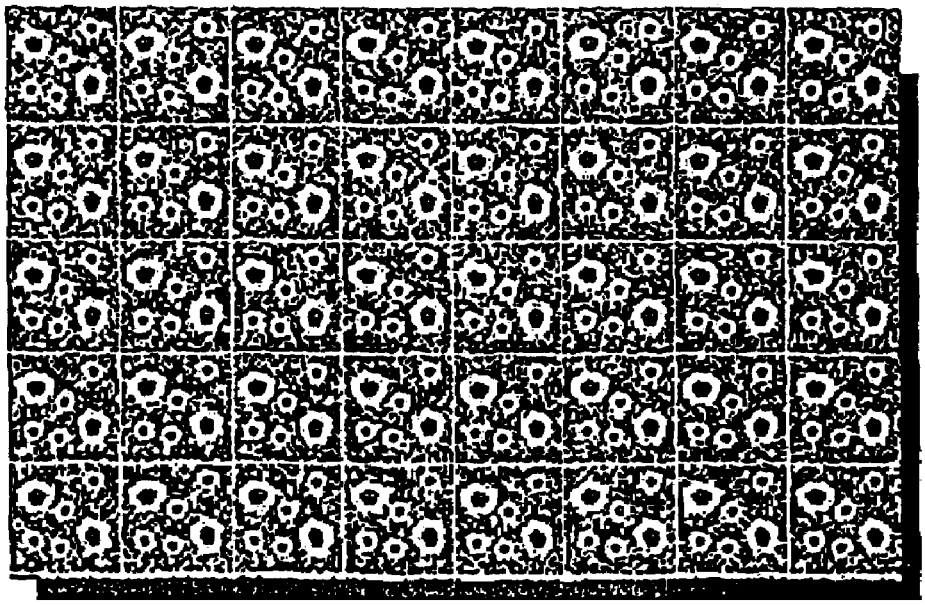

According to the Figures the material contained in mixers (1) and (2) in the form of a mix is unloaded to the levelling hoppers (3) and (4) and extracted from the latter by means of extracting belts (5) and (6).

The mixture is conveyed by such belts to the disc (7) after passing through calibrators (8) and (9).

The disc rotates about its axis and is provided with a particular equipment having the function of a mixer (10) and two unloading vanes (11) that lower at the end of mixing and by their rotation convey the material to the central opening of the disc which is meanwhile opened by raising the central cylinder (12). The mixture falls into the levelling hopper (13) and is extracted by belt (14), passes through calibration rollers (15) and arrives to hopper (16) and then to belt (17).

The mixtures extracted from the levelling hoppers (3) and (4) at a constant speed are fed on a proportional basis to the homogenizing disc rotating about itself. Therefore, the quantity of material distributed on the surface of the disc is constant as it is stratified, thus providing layers of material with different colours perfectly proportioned to the amount of the different mixtures.

Furthermore, before the extracted mixture is fed to the homogenizing disc, it passes through two rollers driven by electrical motors.

Such rollers are positioned at the desired distance as they determine the diameter of any balls/lumps.

The final step of the system is modified with respect to the conventional systems, particularly by driving the feeding belt, replacing the batcher tank, adding further levelling hoppers (18), (20) and (22) and the extracting belt.

In fact, as the conveyor belt (19) is driven by a double-stroke movement, it has the double function of:

extracting the mixture from hopper (18) by the rubber mat;

unloading the mixture homogeneously to hopper (20) because of the particular double-stroke movement.

The arrangement of a belt (21) with suitable size has the following two functions:

extracting the mixture from hopper (20) by the rubber mat and distributing the same on itself (evenly distributed mixture with a surface of 2.00 meters by 1.0 meters);

unloading the mixture as prepared before to the underlying levelling hopper; at the same time the whole construction of the belt is moved and advanced so that it covers the whole surface of the underlying mould (23), thus allowing the mixture to fill the empty spaces of the mould.

Once arrived to the end of stroke, the belt returns to the preceding starting point, thus allowing belt (19) to feed hopper (20) to form a new slab. Then the cycle starts again.

Once filled the mould is conveyed to the following already known steps.

An amount of liquid or powdered colour can be injected into the mixture distributed on belt (21) as described above by means of colour batchers by fall or spray casually or systematically so that veins of the natural type can be provided.

In addition, mixtures with different colours distributed by little belts to said belt can be provided by means of little mixers located at a height above the extracting belt (21) so that leopard skin colourings can be obtained.

Such double system allows colourings similar to natural granite and marble to be reproduced.

The system of the invention described and illustrated can be subjected to formal and structural changes without departing from the scope of the present invention as defined in the appended claims.

The invention claimed is:

1. A system for producing composite material slabs, comprising one or more mixers (1,2) for mixing a material; hoppers (3, 4) to which the material is unloaded from said one or more mixers (1,2); one or more extractor/conveyor belts (5,6) to which the material is unloaded from said hoppers (3,4) and which feed the material; a homogenizing disk (7) which receives the material from said extractor/conveyor belts (5, 6), rotates about a vertical axis and feeds the material; conveyor belts (14,17) which receive the material from said homogenizing disk (7); a leveling hopper (18) which receives the material from the further conveyor belts (14, 17) (18); a double-stroke belt (19) which takes the material from said leveling hopper (18) and unloads it homogeneously; an additional leveling hopper (20) which receives the homogeneously unloaded material from said double-stroke belt (19); an extracting belt (21) which takes the material from said additional leveling hopper (20) and causes as a material to distribute along a length of said extracting belt (21); an underlying leveling hopper (22) to which the material is unloaded from said extracting belt (21), wherein said extracting belt (21) is movable with said underlying leveling hopper (22) that is integral with said extracting belt (21) in an opposite direction to unload the material to an underlying mould (23) so as to cover a whole surface of the mold and to fill the mould.

2. A system as defined in claim 1; and further comprising one or more pairs of rollers located before said homogenizing disk so that the material passes through said one or more pairs of rollers for avoiding any lumps before it is supplied to said homogenizing disk.

3. A system as defined in claim 1; and further comprising color batchers which inject liquid or powder color into the material distributed on said extracting belt before or during transportation to the mold, by fall or spray, so that a product with veins or leopard skin can be produced.

4. A system as defined in claim 1; and further comprising additional mixers located above said extracting belt and providing mixtures of silica granulates, binding agents with different colors, and additional belts for distributing the mixtures to said extracting belt so that leopard skin coloring or vein products can be obtained.

5. A method of producing composite material slabs, comprising the steps of unloading a material from one or more mixers (1, 2) to hoppers (3, 4); unloading the material from the hoppers (3, 4) to one or more extractor/conveyor belts (5, 6); feeding the material from the one or more extractor/conveyor belts (5, 6) to a homogenizing disk (7) rotating about a vertical axis; feeding the material from said homogenizing disk (7) to conveyor belts (14,17) that convey a material to a leveling hopper (18); conveying the material from the leveling hopper (18) with a double-stroke belt (19) which takes the material by its movement and unloads the material homogeneously to an additional leveling (20) hopper; taking the material from the additional leveling hopper (20) by an extracting belt (21) so as to cause the material to distribute along a length of the extracting belt; unloading the material from the extracting belt (21) to an underlying leveling hopper (22); and moving the extracting belt (21) with the underlying leveling hopper(22) that is integral to the extracting belt (21) so as to unload the material to an underlying mold (23), thereby covering the whole surface of the mold and filling the mold.

* * * * *